US007922967B2

(12) United States Patent
Kondoh

(10) Patent No.: US 7,922,967 B2
(45) Date of Patent: Apr. 12, 2011

(54) HIGH-STRENGTH AND HIGH-TOUGHNESS MAGNESIUM BASED ALLOY, DRIVING SYSTEM PART USING THE SAME AND MANUFACTURING METHOD OF HIGH-STRENGTH AND HIGH-TOUGHNESS MAGNESIUM BASED ALLOY MATERIAL

(75) Inventor: Katsuyoshi Kondoh, Minoh (JP)

(73) Assignee: Toudai TLD, Ltd., Tokyo (JP)

( * ) Notice: Subject to any disclaimer, the term of this patent is extended or adjusted under 35 U.S.C. 154(b) by 0 days.

(21) Appl. No.: 12/782,052

(22) Filed: May 18, 2010

(65) Prior Publication Data

US 2010/0226812 A1 Sep. 9, 2010

Related U.S. Application Data

(62) Division of application No. 11/629,282, filed on Dec. 13, 2006, now abandoned.

(51) Int. Cl.
*B22F 3/20* (2006.01)
*C22C 23/06* (2006.01)

(52) U.S. Cl. ..... 419/67; 148/406; 148/420

(58) Field of Classification Search ..... 148/406, 148/420, 667; 419/28, 38, 41, 66, 67; 420/405
See application file for complete search history.

(56) References Cited

U.S. PATENT DOCUMENTS

| | | | | |
|---|---|---|---|---|
| 5,073,207 | A | 12/1991 | Faure et al. | |
| 5,078,962 | A * | 1/1992 | Regazzoni et al. | 420/402 |
| 5,129,960 | A | 7/1992 | Chang et al. | |
| 2002/0020475 | A1 | 2/2002 | Sakamoto et al. | |

FOREIGN PATENT DOCUMENTS

| | | |
|---|---|---|
| EP | 1 526 188 | 4/2005 |
| JP | 3-97824 | 4/1991 |
| JP | 7-48646 | 2/1995 |
| JP | 8-41576 | 2/1996 |
| JP | 2001-59125 | 3/2001 |
| JP | 2002-129272 | 5/2002 |
| JP | 2003-277899 | 10/2003 |

OTHER PUBLICATIONS

"Bulk working" in Magnesium and Magnesium Alloys, ASM Specialty Handbook, ASM International, Copyright 1999, pp. 86, 87, 88.*

Y. Guangyin et al., "Development of a Cheep Creep Resistant Mg-Al-Zn-Si-base Alloy", Materials Science Forum, vols. 419-422 (2003), pp. 425-432.

* cited by examiner

*Primary Examiner* — George Wyszomierski
*Assistant Examiner* — Mark L Shevin
(74) *Attorney, Agent, or Firm* — Clark & Brody

(57) ABSTRACT

A high-strength and high-toughness magnesium based alloy contains, by weight, 1 to 8% rare earth element and 1 to 6% calcium and the maximum crystal grain diameter of magnesium constituting a matrix is not more than 30 μm. At least one intermetallic compound (6) of rare earth element and calcium has a maximum grain diameter of 20 μm or less and it is dispersed in a crystal grain boundary (5) and a crystal grain (4) of magnesium of the matrix.

5 Claims, 5 Drawing Sheets

Inventive example 9

Inventive example 11

Comparative example 16

(a) Inventive example (b) Comparative example

HIGH-STRENGTH AND HIGH-TOUGHNESS MAGNESIUM BASED ALLOY, DRIVING SYSTEM PART USING THE SAME AND MANUFACTURING METHOD OF HIGH-STRENGTH AND HIGH-TOUGHNESS MAGNESIUM BASED ALLOY MATERIAL

CROSS-REFERENCE TO RELATED APPLICATION

This is a divisional of U.S. application Ser. No. 11/629,282 filed Dec. 13, 2006.

TECHNICAL FIELD

The present invention relates to a high-strength and high-toughness magnesium based alloy and more particularly, to a high-strength and high-toughness magnesium based alloy that is superior in strength characteristics such as static tensile characteristics, fatigue strength, and creep characteristics, and superior in toughness such as breaking extension at room temperature and at high temperature up to 200° C. Such high-strength and high-toughness magnesium based alloy is advantageously applied to a car component and especially to an engine part or a mission part used at a high temperature.

BACKGROUND ART

Since a magnesium alloy has low specific gravity and is light in weight, it can be widely used in a package of a mobile phone or a portable acoustic instrument, a car component, a machine part, a structural material and the like. Especially, in order to maximize the effect of light in weight, it is to be employed in a part of motor system or an operating system and more particularly, in a part of an engine system or driving system like a piston.

However, these parts and members require heat resistance characteristics around 200° C. in addition to the strength and toughness at room temperature. According to a conventional magnesium alloy, Mg—Al—Zn—Mn group alloy such as AZ91D alloy or Mg—Al—Mn group alloy such as AM60B alloy defined in JIS standard, for example, since its strength is lowered at a temperature above 120° C., it cannot be used in the above part.

In order to answer the needs for reduction in weight, an alloy in which the heat resistance characteristic of magnesium alloy is improved has been aggressively developed. For example, in "Materials Science Forum Vols. 419-422 (2003) pp. 425 to 432" in "Magnesium Alloys 2003" at Magnesium International Conference (Osaka International Conference Hall on Jan. 26 to 30, 2003), Mr. Y. Guangyin and the like announced that they developed a Mg—Al—Zn—Si—Sb-RE group alloy by a casting method and the alloy had tensile strength of 178 MPa and a breaking extension of 14% at 150° C. However, according to this alloy, since the average crystal grain diameter of magnesium that constitutes a matrix is 70 μm which is relatively large, its tensile strength is 235 MPa and breaking extension is 9% at room temperature, so that it cannot be applied to the above part.

Japanese Unexamined Patent Publication No. 2002-129272 discloses a Mg—Al—Zn—Ca-RE-Mn group magnesium alloy for die-casting that is superior in creep characteristics at high temperature around 150° C. Since the magnesium alloy disclosed in this document is manufactured by the casting method similar to the case by Mr. Guangyin and the like, the following problems are pointed out.

(1) The crystal grain of magnesium is as large as 60 to 150 μm.

(2) The compound such as $Al_{11}RE_3$, $Al_2Ca$, and $Mg_{17}Al_{12}$ deposited and dispersed in the matrix grows to be coarse and becomes an acicular compound having a length of 20 to 40 μm or more.

(3) The acicular compound exist in a magnesium crystal grain boundary and when it is excessively formed, it exists like a network along the boundary.

As a result, there arises a problem such that it is inferior in strength and toughness at room temperature. Furthermore, when each element is added excessively in order to improve the tensile characteristics at high temperature, a problem such as fluidity or hot cracking is generated at the time of casting, so that the content of an additive element is limited and further improvement in heat resistance characteristics is not expected. For example, a magnesium alloy provided by die-casting disclosed in the Japanese Unexamined Patent Publication No. 2002-129272 is defined in its appropriate content within a range containing, by weight, 1 to 3% RE, 1 to 3% Ca, and 0.5 to 8% Al.

According to a high-strength magnesium alloy and a heat treatment method of a magnesium alloy cast disclosed in Japanese Unexamined Patent Publication No. 8-41576, it is described that a cast alloy containing, by weight, 1 to 4% Al, 1 to 8% RE, 0.3 to 1.3% Ca, 0.1 to 2% Mn and the balance Mg has superior creep characteristics. Furthermore, when a heat treatment such as solution treatment or ageing treatment is performed to the Mg alloy according to need, the characteristics are improved by enhancement of solid solution of Al or Ca and enhancement of deposition of Mg—Ca group compound.

However, since the magnesium alloy disclosed in the Japanese Unexamined Patent Publication No. 8-41576 is manufactured by the casting method, the Mg crystal grain is inevitably grown and becomes coarse during its solidification. As a result, since its tensile strength becomes 200 to 280 MPa at room temperature, it cannot be applied to a car equipment or a machine part or a structural material.

The inventor of the present invention found that the following conditions were required to implement both high strength and high toughness (extension) of the magnesium alloy within a temperature range from room temperature up to around 200° C.

(1) The crystal grain diameter of a magnesium alloy that constitutes a matrix is to be miniaturized.

(2) A compound that is superior in heat resistance is to be uniformly deposited and dispersed not as an acicular grain but as a fine grain.

(3) The above compound grain is to be dispersed in a magnesium crystal grain as much as possible.

(4) In order to deposit and disperse the fine compound superior in heat resistance as much as possible, it is effective to use a solid-phase (non-dissolved) manufacturing method not using a conventional casting or die-casting method but using a plastic forming method using powder or chips as a starting raw material.

DISCLOSURE OF THE INVENTION

The present invention has been made in view of the above findings and it is an object of the present invention to provide a high-strength and high-toughness magnesium based alloy that is superior in tensile strength, breaking extension and fatigue strength at room temperature and at the same time has high heat resistance characteristics at around 200° C.

It is another object of the present invention to provide a manufacturing method of a high-strength and high-strength magnesium based alloy material having the above superior characteristics.

A high-strength and high-toughness magnesium based alloy according to the present invention contains, by weight, 1 to 8% rare earth element and 1 to 6% calcium, and characterized in that the maximum crystal grain diameter of magnesium that constitutes a matrix is not more than 30 μm.

Preferably, the magnesium based alloy contains at least one intermetallic compound of the rare earth element and the calcium, in which the maximum grain diameter of the intermetallic compound is not more than 20 μm. One example of the intermetallic compound is a compound of aluminum and rare earth element. Another example of the intermetallic compound is a compound of aluminum and calcium.

When it is assumed that the maximum grain diameter of the intermetallic compound is "D" and the minimum grain diameter thereof is "d", $D/d \leqq 5$ is satisfied. Further preferably, the intermetallic compound is dispersed in the crystal grain boundary and crystal grain of magnesium that constitutes the matrix. Here, the maximum grain diameter means the maximum length of the compound grain and the minimum grain diameter means the minimum length of the compound grain.

Preferably, the maximum crystal grain diameter of magnesium that constitutes the matrix is not more than 20 μm. More preferably, it is not more than 10 μm.

According to one embodiment, the high-strength and high-toughness magnesium based alloy contains at least one kind of element selected from a group consisting of, by weight, 0.5 to 6% Zinc, 2 to 15% aluminum, 0.5 to 4% manganese, 1 to 8% silicon and 0.5 to 2% silver.

Focusing on the mechanical characteristics of the high-strength and high-toughness magnesium based alloy according to the present invention, a tensile strength ($\sigma$) is not less than 350 MPa and a breaking extension ($\epsilon$) is not less than 5%. In addition, focusing on another viewpoint, the product of the tensile strength ($\sigma$) and the breaking extension ($\epsilon$) is such that $\sigma \times \epsilon \geqq 4000$ MPa·%.

Preferably, the rare earth element contains at least one kind of element selected from a group consisting of cerium (Ce), lanthanum (La), yttrium (Y), ytterbium (Yb), gadolinium (Gd), terbium (Tb), scandium (Sc), samarium (Sm), praseodymium (Pr), and neodymium (Nd).

According to one embodiment, the high-strength and high-toughness magnesium based alloy contains, by weight, 1.5 to 4% manganese, 2 to 15% aluminum and iron of 10 ppm or less and the maximum grain diameter of an Al—Mn compound is not less than 20 μm. Here, it is to be noted that the term "iron of 10 ppm or less includes that iron is not included.

According to the high-strength and high-toughness magnesium based alloy comprising the above constitution, since there is provided a structure in which the matrix comprises magnesium having fine crystal grain diameter and the fine granular intermetallic compound is uniformly deposited and dispersed in the crystal grain, it can be advantageously applied to a driving system part for a car or a two-wheeled motor vehicle.

A manufacturing method of the high-strength and high-toughness magnesium based alloy material according to the present invention comprises the following steps.

(1) A step of miniaturizing a magnesium crystal grain that constitutes a matrix and miniaturizing a compound grain dispersed in the matrix by performing a plastic forming process to magnesium based alloy powder containing, by weight, 1 to 8% rare earth element and 1 to 6% calcium.

(2) A step of manufacturing a powder solidified body from the miniaturized magnesium based alloy powder by compression molding.

(3) A step of providing an alloy material by heating the powder solidified body and immediately performing a warm extrusion process to it.

The working effect of the above-described present invention will be described in the following "BEST MODE FOR CARRYING OUT INVENTION" and "EXAMPLES")

BEST MODE FOR CARRYING OUT THE INVENTION

Effect of Each Additive Element (1) Rare earth (RE) element

A rare earth (RE) element component forms a Mg-RE compound with magnesium that is a matrix, and forms Al-RE compound with aluminum (Al) that is an example of an additive component. Since the compound such as $Al_2RE$ or $Al_{11}RE_3$ is superior in heat stability as compared with Mg—Al group compound such as $Mg_2Al_3$ or $Mg_{17}Al_{12}$, when its fine powder is diffused uniformly in the matrix, the heat resistance characteristics of a magnesium alloy can be improved.

The appropriate range of a rare earth (RE) element content is 1 to 8% by weight. When the rare earth (RE) element content is less than 1%, the heat resistance characteristics are not sufficiently improved. Meanwhile, when the rare earth (RE) element content is more than 8%, the effect is not increased and on the contrary, the deposited amount of the compound becomes excessive, which causes a problem in the subsequent process. That is, when a secondary process such as warm forging, rolling or drawing is performed for the provided magnesium alloy, cracking is generated due to lack of toughness. A more preferable rare earth element content to provide both high strength and high toughness and preferable secondary process workability is 3 to 5%.

Figure 1:
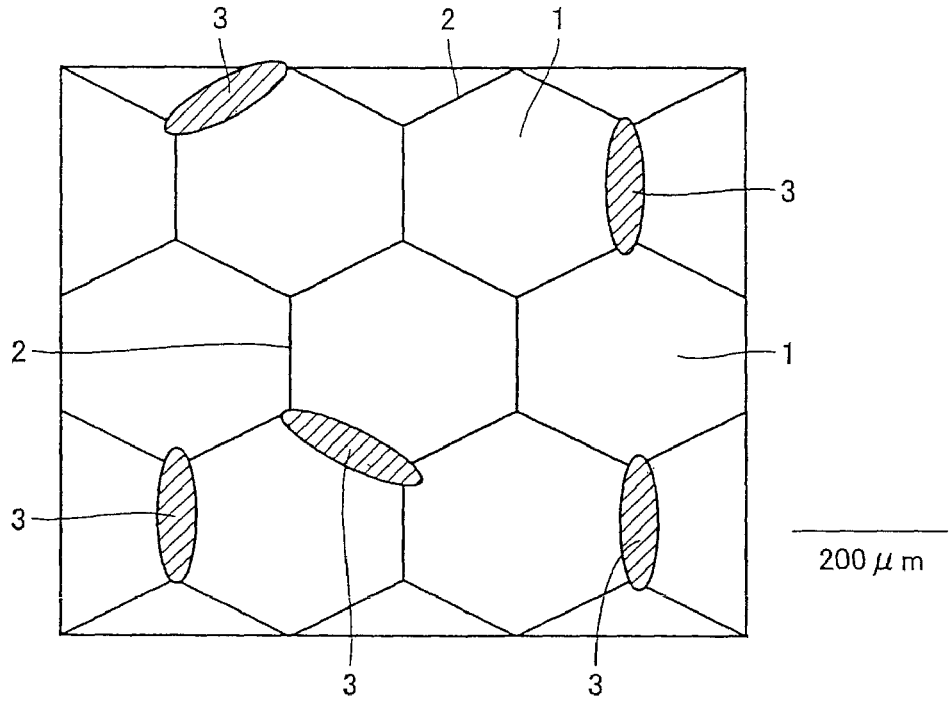
FIG. 1 is a view schematically showing the crystal structure of a magnesium based alloy manufactured by a casting method.

By a normal casting method or a die-casting method, the Mg-RE group compound and the Al-RE group compound are deposited along a crystal grain boundary ($\alpha$ crystal grain boundary) of magnesium and exist as acicular compounds or network-like compounds formed with the connected acicular compounds as shown in FIG. 1.

FIG. 1 is a view schematically showing the crystal structure of a magnesium based alloy manufactured by a casting method. A magnesium crystal grain 1 that constitutes a matrix is coarse and an acicular intermetallic compound 3 is provided along a crystal grain boundary 2. When the acicular intermetallic compound 3 exists along the crystal grain boundary 2 of the matrix in this way, the mechanical characteristics of the magnesium based alloy is lowered.

Figure 2:
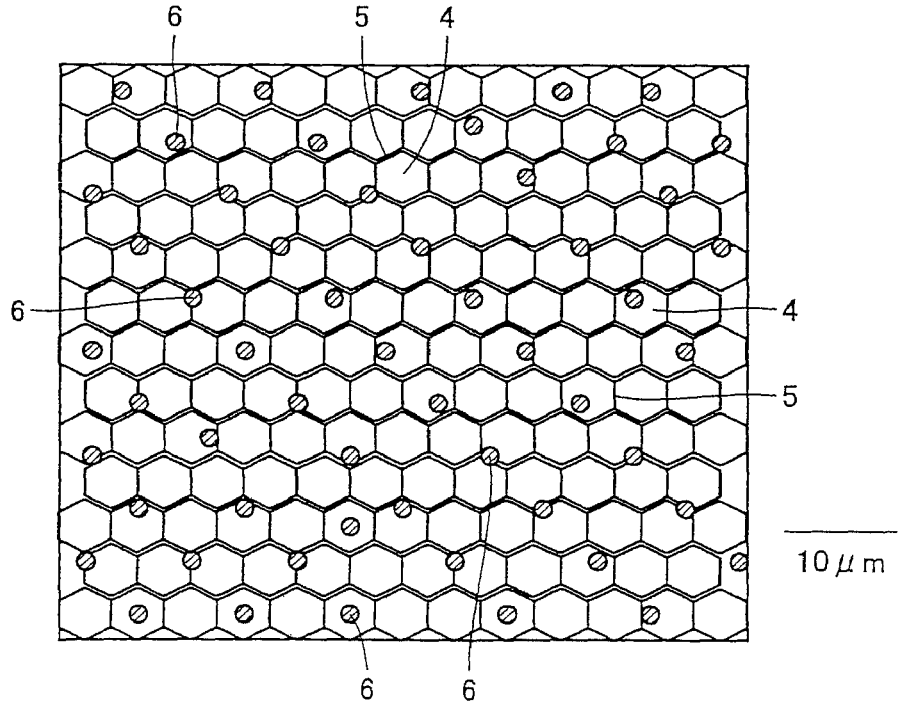
FIG. 2 is a view schematically showing the crystal structure of a magnesium based alloy manufactured by a solid-phase manufacturing method using a plastic forming method.

In view of the improvement in strength and toughness of the magnesium based alloy, it is desirable that the intermetallic compound is dispersed in the crystal grain as a fine granular compound. FIG. 2 is a view schematically showing the crystal structure of a magnesium based alloy manufactured by a method of the present invention that will be described below, that is, a solid-phase manufacturing method using a plastic forming method. A magnesium crystal grain 4 that constitutes a matrix is fine and a fine granular intermetallic compound 6 is dispersed in a crystal grain boundary 5 and the crystal grain 4. The magnesium based alloy having the above structure provides superior characteristics in strength and toughness.

Regarding the size of the intermetallic compound, a maximum grain diameter is preferably not more than 20 μm in view of providing both high strength and high toughness, and more preferably, it is not more than 10 μm. When the maximum grain diameter of the intermetallic compound is more than 20 μm, the toughness (breaking extension or an impact resistance value) of the magnesium alloy at room temperature is lowered and especially when it is more than 30 μm, the strength is lowered with the lowering of the toughness.

Regarding the configuration of the intermetallic compound, it is more preferably granular than acicular. More specifically, when it is assumed that the maximum grain diameter of the compound grain is "D" and the minimum grain diameter thereof is "d", by making an aspect ratio D/d below 5, both high strength and high toughness can be provided. In view of the improvement of fatigue strength, it is more preferably made below 3. Meanwhile, when the ratio D/d is more than 5, the magnesium alloy becomes defective and since a stress is concentrated at that part, the toughness is lowered.

Since the ratio D/d of the acicular compound deposited along the αcrystal grain boundary by the casting method or die-casting method is 5 to 20, it is difficult to provide high strength and high toughness, and it is also difficult to provide high fatigue strength.

In addition, as the rare earth element, cerium (Ce), lanthanum (La), yttrium (Y), ytterbium (Yb), gadolinium (Gd), terbium (Tb), scandium (Sc), samarium (Sm), praseodymium (Pr), neodymium (Nd) and the like may be used. In addition, a misch metal containing the above rare earth element may be used.

(2) Calcium (Ca)

Calcium (Ca) forms an Al—Ca group compound such as $Al_2Ca$ with aluminum (Al) that is one example of the additive component. Since this intermetallic compound is superior in heat stability as compared with the Mg—Al group compound such as $Mg_2Al_3$ or $Mg_{17}\beta l_{12}$ similar to the above Al-RE group compound, when its fine compound grains are uniformly dispersed in the matrix, the heat resistance characteristics of the magnesium alloy can be improved. In addition, when Zn is contained, a Mg—Zn—Ca group compound is formed and this contributes to the improvement of the heat resistance characteristics similar to $Al_2Ca$.

An appropriate calcium content is 1 to 6% by weight. When the calcium content is less than 1%, the effect of the improvement of the heat resistance characteristics is not sufficiently provided. Even when the calcium content is more than 6%, the effect is not increased and on the contrary, the deposited amount of the compound becomes excessive and a problem is raised in the subsequent process. That is, when a secondary process such as warm forging, rolling or drawing is performed for the provided magnesium alloy, cracking is generated due to lack of toughness. A more preferable calcium content to provide both high strength and high toughness and preferable secondary process workability is 2 to 5%.

By a normal casting method or a die-casting method, the Al—Ca group compound and the Mg—Zn—Ca group compound are also deposited along a crystal grain boundary (α crystal grain boundary) of magnesium and exist as acicular compounds or network-like compounds formed with the connected acicular compounds. As a result, the mechanical characteristics of the magnesium based alloy is lowered. Hence, according to the present invention, as described above, by applying strong processing strain when a powdered or aggregated starting raw material is solidified by the plastic forming method, the acicular or network-like Al—Ca group compound and Mg—Zn—Ca group compound are finely ground and uniformly dispersed in the magnesium crystal grain boundary and the magnesium crystal grain as shown in FIG. 2.

Regarding the size of the intermetallic compound, a maximum grain diameter is preferably not more than 20 μm in view of providing both high strength and high toughness, and more preferably, it is not more than 10 μm. When the maximum grain diameter of the intermetallic compound is more than 20 μm, the toughness (breaking extension or an impact resistance value) of the magnesium alloy at room temperature is lowered and especially when it is more than 30 μm, the strength is lowered with the lowering of the toughness.

Regarding the configuration of the intermetallic compound, it is more preferably granular than acicular. More specifically, when it is assumed that the maximum grain diameter of the compound grain is "D" and the minimum grain diameter thereof is "d", by making an aspect ratio D/d below 5, both high strength and high toughness can be provided. In view of the improvement of fatigue strength, it is more preferably made below 3. Meanwhile, when the ratio D/d is more than 5, the magnesium alloy becomes defective and since a stress is concentrated at that part, the toughness is lowered. Since the ratio D/d of the acicular compound deposited along the α crystal grain boundary by the casting method or die-casting method is 5 to 20, it is difficult to provide high strength and high toughness, and it is also difficult to provide high fatigue strength.

(3) Aluminum (Al)

Aluminum forms a Mg—Al group compound with magnesium of the matrix and forms a Mg—Zn—Al group compound. Since the latter is superior in heat resistance, when it is deposited and finely dispersed in the matrix, it contributes to the improvement of the heat resistance characteristics of the magnesium alloy. In order to provide such effect, an Al content has to be not less than 2% by weight. Meanwhile, when the Al content is more than 15%, a crack is generated in an ingot in the course of manufacturing the ingot, causing the productivity and yield to be lowered. Therefore, the appropriate content of the Al component in the magnesium alloy in the present invention is preferably in a range of 2 to 15% and in view of providing both high strength and high toughness and the above preferable secondary process workability, it is more preferably in a range of 6 to 12%.

(4) Zinc (Zn)

Although zinc forms a Mg—Zn compound with magnesium of the matrix, since this two-element compound is inferior in heat stability, it lowers the heat resistance characteristics of the magnesium alloy. However, as described above, when Al is added, a Mg—Zn—Al group compound or Mg—Zn—Ca group compound that is superior in heat resistance is formed and when solid solution hardens the matrix as will be described below, it contributes to the improvement of the heat resistance characteristics and mechanical characteristics of the magnesium alloy at room temperature. An appropriate Zn content in the magnesium alloy in the present invention is 0.5 to 6% by weight. When it is less than 0.5%, the above effect is not sufficiently provided but when it is more than 6%, the toughness of the magnesium alloy is lowered.

(5) Manganese (Mn)

Manganese (Mn) becomes solid solution in the magnesium matrix and it contributes to the improvement of the mechanical characteristics and especially resistance because of solid solution hardening. An appropriate Mn content in the magnesium alloy in the present invention is 0.5 to 4% by weight. When it is less than 0.5%, the above effect cannot be sufficiently provided but when it is more than 4%, the toughness of the magnesium alloy is lowered.

When the Mn content is 1.5 to 4%, a Fe content in the magnesium based alloy is preferably not more than 10 ppm and more preferably not more that 3 ppm, and at the same time the maximum grain diameter of the Al—Mn compound is preferably not more than 20 μm and more preferably not more than 10 μm.

When a lot of Mn is added, the Fe content that lowers corrosion resistance is reduced in the cast magnesium ingot, so that corrosion resistance of the magnesium alloy is improved. However, when Mn is added excessively (1% or more, for example), the Al—Mn compound becomes coarse (about 20 to 80 μm, for example), which lowers the mechanical characteristic and processability of the magnesium alloy.

However, when a mechanical grinding and miniaturizing process according to the present invention that will be described below is used, the above described structure in which the maximum grain diameter of the Al—Mn compound is not more than 20 μm and more preferably not more than 10 μm can be implemented, so that the magnesium based alloy can provide balanced corrosion resistance and mechanical characteristics.

(6) Silver (Ag)

Silver (Ag) becomes solid solution in the magnesium matrix and it contributes to the improvement of the mechanical characteristics and especially resistance because of solid solution hardening. An appropriate Ag content in the magnesium alloy in the present invention is 0.5 to 2% by weight. When it is less than 0.5%, the above effect cannot be sufficiently provided but when it is more than 2%, the toughness of the magnesium alloy is lowered.

(7) Silicon (Si)

Silicon (Si) forms magnesium silicide ($Mg_2Si$) with magnesium of the matrix. Since this magnesium silicide has high rigidity, high hardness and high corrosion resistance, when it is dispersed in the matrix, the above characteristics in the magnesium alloy can be improved also. When a Si content is less than 1% by weight, this effect is not sufficient but when it is more than 8%, the toughness of the magnesium alloy, extension in the tensile characteristics especially is considerably lowered and at the same time, tool abrasion in the cutting process is generated and material surface roughness is lowered associated with it.

[Maximum Crystal Grain Diameter of Magnesium of Matrix]

According to the magnesium alloy of the present invention, both strength and toughness can be improved by miniaturizing the magnesium crystal grain that constitutes the matrix. More specifically, it has been found that when the maximum crystal grain diameter of magnesium is not more than 30 μm, the magnesium alloy has high strength and high toughness such that tensile strength is not less than 350 MPa and breaking extension is not less than 5% at room temperature. Especially, when the maximum crystal grain diameter is not less than 20 μm, the magnesium alloy has high strength above 400 MPa. Furthermore, it has been found that when the maximum crystal grain diameter of magnesium is below 10 μm, during the process of plastic forming of Mg raw material powder, since its texture is disordered, the Mg alloy provides high toughness and improves its bending and pressing processability at low temperature.

[Manufacturing Method of High-Strength and High-Toughness Magnesium Based Alloy Material]

Figure 3:
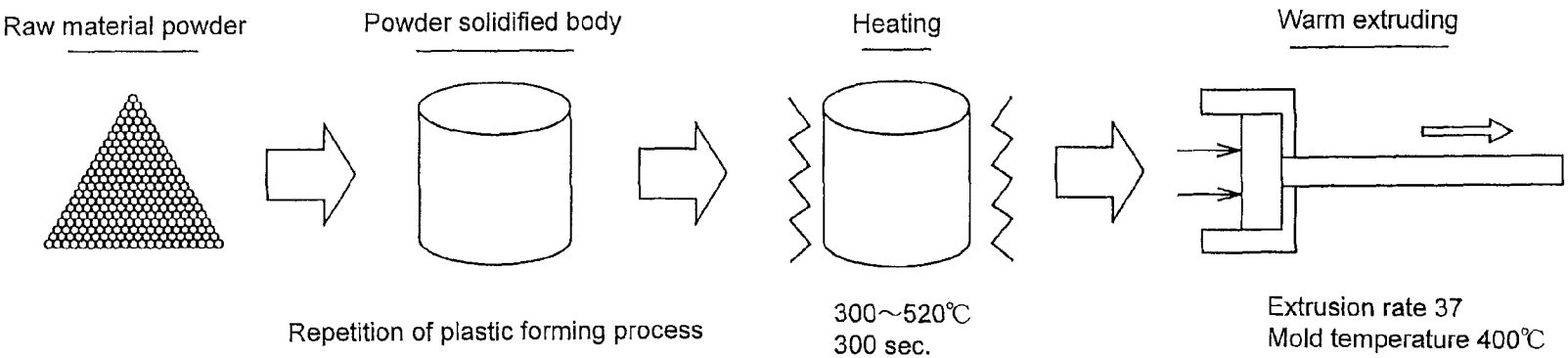
FIG. 3 is a view showing manufacturing steps of a high-strength and high-toughness magnesium based alloy material according to the present invention.

FIG. 3 shows manufacturing steps of a high-strength and high-toughness magnesium based alloy material according to the present invention. The method of the present invention will be described in detail with reference to FIG. 3.

(1) Preparation of Raw Material Powder

A magnesium alloy ingot having a predetermined component composition is manufactured by the casting method. The predetermined component composition contains, by weight, 1 to 8% rare earth element and 1 to 6% calcium and according to need, it further contains at least one kind selected from an element group consist of, by weight, 0.5 to 6% zinc, 2 to 15% aluminum, 0.5 to 4% manganese, 1 to 8% silicon, and 0.5 to 2% silver.

Then, powder, aggregated grain, chip and the like is provided from the magnesium alloy ingot manufactured by the casting method through a machining process such as cutting or grinding process, and used as starting raw material powder.

(2) Miniaturization of Crystal Grain and Miniaturization of Compound Grain

Prior to manufacturing of powder solidified body, a plastic forming process such as compression molding, extruding, casting, or rolling is performed for the starting material powder to miniaturize the magnesium crystal grain that constitutes the matrix and miniaturize the compound grain dispersed in the matrix to provide a crystal structure shown in FIG. 2.

When strong processing strain is applied to the starting raw material, the acicular or network-like intermetallic compound (for example, Mg-RE group compound or Al-RE group compound) can be finely ground and uniformly dispersed in the magnesium crystal grain that constitutes the matrix.

As the method applying the strong processing strain to the magnesium alloy raw material powder, a method in which compression molding or extruding are performed or a shearing process, bending process, rotation shearing process and the like are performed for the powder in a mold and the like, or a method of rolling the powder, or a method in which a grinding process is performed with a ball mill and the like are effective. In order to effectively miniaturize the intermetallic compound and the magnesium crystal grain, the plastic forming method is preferably performed in a warm region at 100 to 300° C.

Figure 4:
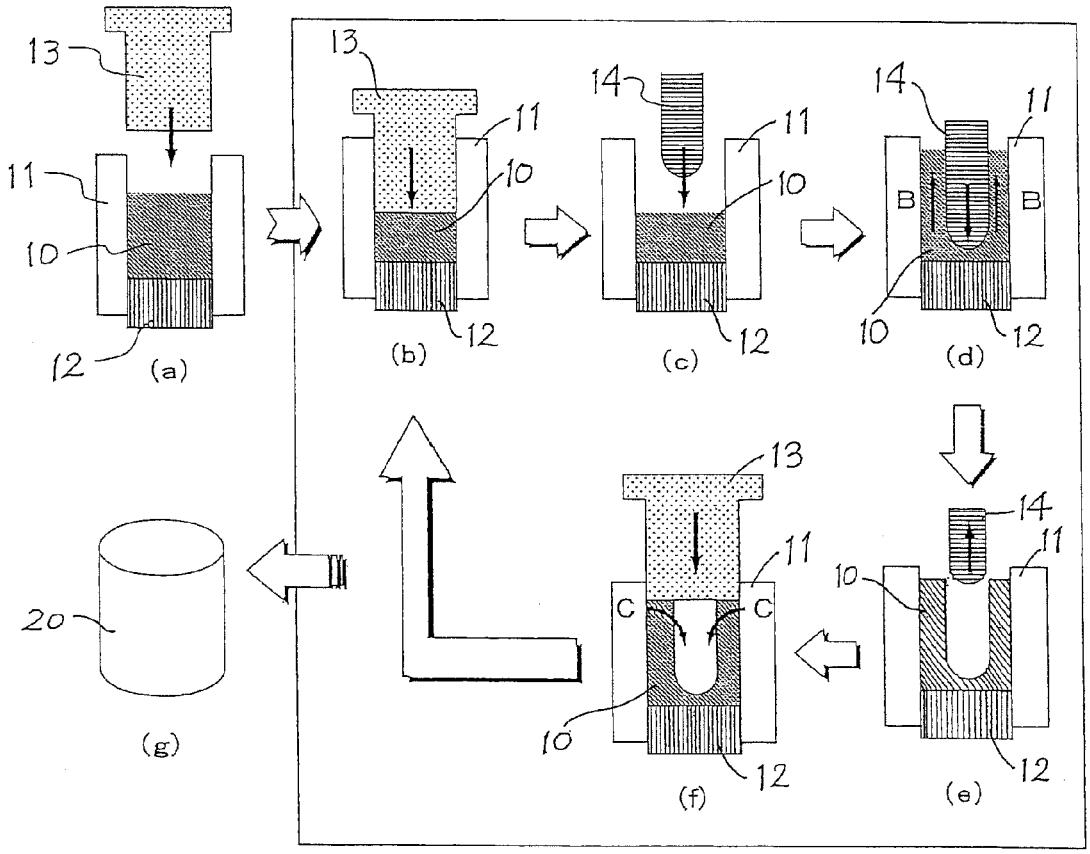
FIG. 4 is a view showing one example of steps performed repeatedly for starting raw material powder until a powder solidified body is finally obtained.

FIG. 4 shows one example of the processes in which the plastic forming processes are repeatedly performed for starting raw material powder 10 until a powder solidified body 20 is finally provided. One example of the method to apply the strong processing strain will be described with reference to FIG. 4.

First, as shown in FIG. 4(*a*), a container comprising a mold mill 11 and a lower punch 12 is filled with the powder 10. Then, as shown in FIG. 4(*b*), a compression upper punch 13 is lowered in the mold mill 11 to compress the raw material powder 10. Then, as shown in FIGS. 4(*c*) and 4(*d*), after the compression upper punch 13 has been retreated, an indenting upper punch 14 is inserted into the compressed raw material powder 10. The compressed raw material powder 10 is extruded backward (a direction shown by an arrow B in FIG. 4) by the indenting upper punch 14 and receives strong processing strain.

Then, as shown in FIGS. 4(*e*) and 4(*f*), after the indenting upper punch 14 has been retreated, the compressed raw material powder 10 having a U-shaped section is compressed by the compression upper punch 13 again. The raw material powder 10 existing along the inner wall surface of the mold mill 11 is moved inwardly (direction shown by an arrow C in FIG. 4) in the mold mill 1 by the above compression.

A series of processes as shown in FIGS. 4(*b*) to 4(*f*) is repeated to mechanically grind the raw material powder and miniaturize the magnesium crystal grain of the matrix. At the same time, the intermetallic compound is also finely ground and dispersed in the magnesium crystal grain.

(3) Manufacturing of Powder Solidified Body

As shown in FIG. 4(*g*), after the miniaturizing process by performing the necessary plastic forming process to the magnesium based alloy raw material powder 10, the powder solidified body 20 is manufactured by compression molding.

(4) Heating and Warm Extruding

For example, the powder solidified body provided as described above is heated up to 300 to 520° C. and maintained for 30 seconds and immediately processed by a warm extrusion process under a condition that an extrusion rate is 37 and a mold temperature is 400° C. to be a rod-like material. The above warm extrusion process promotes the miniaturization of the magnesium crystal grain and the compound grain. More specifically, the compound grain is mechanically cut and further miniaturized by the plastic process using the extrusion process, and the magnesium crystal grain is dynamically recrystallized and further miniaturized through the process and the heat treatment.

[Mechanical Characteristics of Magnesium Based Alloy]

Since the magnesium based alloy according to the present invention is superior in strength and toughness within a temperature range from room temperature to about 200° C., it can be used as an engine part or a transmission part of a car or a two-wheeled motor vehicle. When the magnesium alloy contains the above appropriate component element defined by the present invention, and the matrix magnesium has the crystal grain diameter that satisfies the appropriate range, the tensile strength ($\sigma$) of 350 MPa or more and the breaking extension ($\epsilon$) of 5% or more at room temperature are implemented. More preferably, the tensile strength is 400 MPa or more. In addition, the magnesium alloy has high strength and high toughness in which the product of the tensile strength ($\sigma$) and the breaking extension ($\epsilon$) is such that $\sigma \times \epsilon \geqq 4000$ MPa·%.

Meanwhile, when the magnesium based alloy has the tensile strength ($\sigma$) of 350 MPa or more and breaking extension ($\epsilon$) of 5% or more at room temperature and/or satisfies that $\sigma \times \epsilon \geqq 4000$ MPa·%, it can be used as a driving part used in a car or a two-wheeled motor vehicle such as a piston, a cylinder liner, a con-rod and the like

Example 1

Magnesium based alloy powder (grain diameter: 0.5 to 2 mm) having the alloy composition shown in Table 1 was prepared and a mold was filled with it and then a powder solidified body was manufactured by compression molding. This solidified body was maintained at 400 to 480° C. for 5 minutes in an inert gas atmosphere and then immediately a warm extrusion process was performed for it to provide an extruded material (diameter: 7.2 mm $\phi$).

The structure in the extruded direction of the above material was observed after polishing and chemical etching and the maximum crystal grain diameter of magnesium of the matrix was measured by image analysis. In addition, a round rod extensile test piece (diameter: 3 mm $\phi$ and parallel part: 15 mm) was obtained from the extruded material and tested at room temperature and 150° C. The tensile speed was kept constant at 0.3 mm/min and in the tensile test at 150° C., a test piece was heated and maintained at 150° C. for 100 hours before the test and tested.

These characteristic evaluation results are shown in Table 1. Regarding the crystal grain miniaturization of the matrix, while the magnesium based alloy powder was heated and maintained at 100 to 300° C., a plastic forming process (compression, extrusion, shearing process and the like) was performed by press molding or rolling, and magnesium based alloy powder having different crystal grain diameters was manufactured. In addition, according to a comparative example 19, an extruded material was heat treated at 400° C. for 20 hours in an inert gas atmosphere to coarse the crystal grain.

According to the inventive examples 1 to 11, each extruded material has the appropriate alloy composition and appropriate Mg maximum crystal grain diameter defined by the present invention, so that it has superior mechanical characteristics at room temperature. Especially, when the maximum crystal grain diameter Mg is below 10 μm as shown in the inventive examples 10 and 11, the extension (toughness) is improved as well as strength.

Meanwhile, according to the comparative examples 12 to 18, since the extruded material does not have the alloy composition defined by the present invention, it does not have enough strength. Especially, in the comparative examples 14 and 15, since a RE or Ca content exceeds an appropriate range, the toughness is lowered and as a result, the tensile strength is also lowered. According to the comparative example 19, since the Mg maximum crystal grain diameter is as large as 66.8 μm, the strength characteristics are not sufficiently provided.

TABLE 1

| | | Chemical composition in weight | | | | | | | | Maximum crystal grain diameter of magnesium matrix | Tensile characteristics at room temperature | | | UTS (MPa) at |
|---|---|---|---|---|---|---|---|---|---|---|---|---|---|---|
| | No. | RE | Ca | Zn | Al | Mn | Si | Ag | Mg | (μm) | UTS (MPa) | Extension (%) | σ × ε (MPa. %) | 150° C. |
| Inventive example | 1 | 3.0 | 1.2 | 0.7 | 7.5 | 1.0 | 0.0 | 0.0 | balance | 22.1 | 383 | 14.4 | 5515 | 134 |
| | 2 | 1.8 | 2.2 | 0.0 | 6.5 | 0.0 | 0.0 | 0.0 | balance | 18.0 | 376 | 13.8 | 5189 | 131 |
| | 3 | 4.6 | 3.8 | 0.5 | 4.0 | 0.0 | 0.0 | 0.0 | balance | 14.3 | 388 | 15.2 | 5898 | 136 |
| | 4 | 5.8 | 4.8 | 0.0 | 0.0 | 0.5 | 0.0 | 0.0 | balance | 17.2 | 368 | 14.2 | 5226 | 126 |
| | 5 | 3.5 | 2.0 | 0.0 | 6.0 | 0.0 | 0.0 | 0.0 | balance | 15.2 | 398 | 11.2 | 4458 | 139 |
| | 6 | 3.0 | 1.0 | 0.5 | 7.5 | 0.5 | 1.5 | 1.0 | balance | 16.5 | 412 | 9.8 | 4038 | 146 |
| | 7 | 3.0 | 1.0 | 0.5 | 7.5 | 0.5 | 0.0 | 0.0 | balance | 14.0 | 418 | 9.6 | 4013 | 148 |
| | 8 | 3.5 | 1.5 | 0.8 | 7.0 | 0.5 | 0.0 | 0.0 | balance | 26.2 | 365 | 16.2 | 5913 | 124 |
| | 9 | 3.5 | 1.5 | 0.8 | 7.0 | 0.5 | 0.0 | 0.0 | balance | 15.4 | 394 | 11.1 | 4373 | 138 |
| | 10 | 3.5 | 1.5 | 0.8 | 7.0 | 0.5 | 0.0 | 0.0 | balance | 9.3 | 406 | 12.6 | 5116 | 140 |
| | 11 | 3.5 | 1.5 | 0.8 | 7.0 | 0.5 | 0.0 | 0.0 | balance | 3.7 | 426 | 14.8 | 6305 | 149 |
| Comparative example | 12 | 3.0 | 0.0 | 0.5 | 3.5 | 0.5 | 0.0 | 0.0 | balance | 20.1 | 324 | 19.3 | 6253 | 110 |
| | 13 | 0.0 | 3.5 | 0.0 | 4.0 | 0.0 | 0.0 | 0.0 | balance | 15.5 | 319 | 18.8 | 5997 | 107 |
| | 14 | 9.5 | 2.2 | 0.0 | 0.0 | 0.0 | 0.0 | 0.0 | balance | 16.4 | 289 | 2.7 | 780 | 102 |
| | 15 | 2.5 | 7.2 | 0.0 | 0.0 | 0.0 | 0.0 | 0.0 | balance | 18.3 | 262 | 2.1 | 550 | 98 |
| | 16 | 0.0 | 0.0 | 1.0 | 9.0 | 0.5 | 0.0 | 0.0 | balance | 27.3 | 336 | 15.6 | 5242 | 115 |
| | 17 | 0.0 | 0.0 | 1.1 | 6.1 | 0.5 | 0.0 | 0.0 | balance | 24.8 | 305 | 17.2 | 5246 | 104 |
| | 18 | 0.0 | 0.0 | 1.0 | 3.1 | 0.4 | 0.0 | 0.0 | balance | 28.2 | 280 | 16.9 | 4732 | 101 |
| | 19 | 3.5 | 1.5 | 0.8 | 7.0 | 0.5 | 0.0 | 0.0 | balance | 66.8 | 318 | 18.8 | 5978 | 106 |

Example 2

Figure 5A:
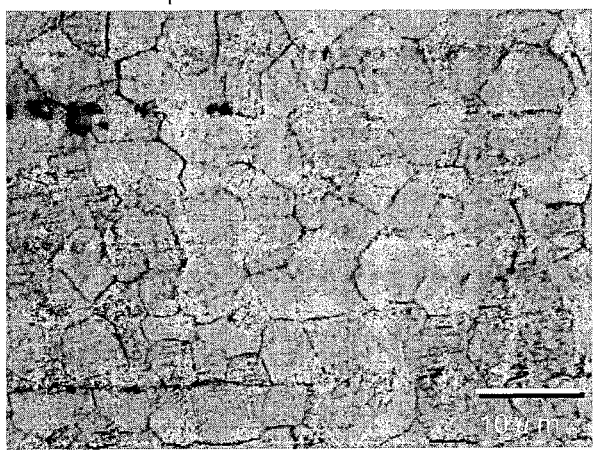
FIG. 5A shows a structure photograph of a working example 9 shown in Table 1.
Figure 5B:
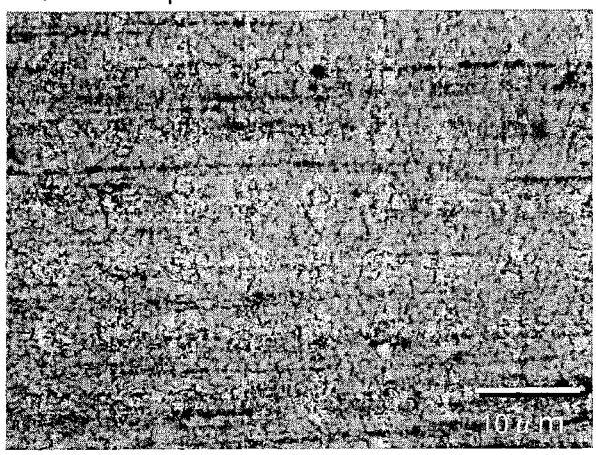
FIG. 5B shows a structure photograph of a working example 11 shown in Table 1.
Figure 5C:
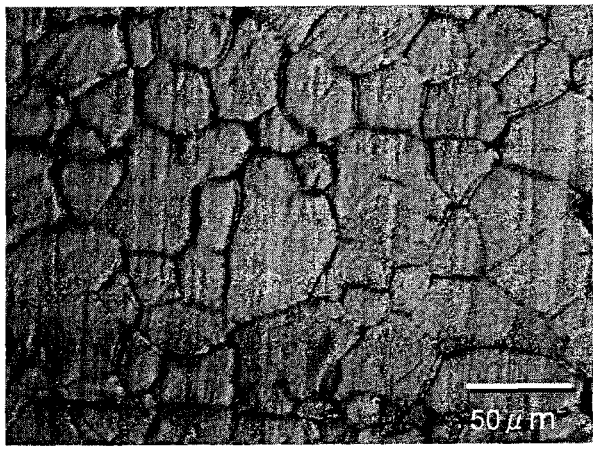
FIG. 5C shows a structure photograph of a comparative example 16 shown in Table 1.

The structure photographs of the inventive examples 9 and 11 and the comparative example 16 shown in Table 1 are shown in FIG. 5. It is clearly found by observing and comparing those structure photographs that the magnesium crystal grains of the extruded materials of the inventive examples 9 and 11 are miniaturized.

Example 3

An ingot containing, by weight, 3.5% RE, 1.5% CA, 0.8% Zn, 7% of Al, 0.5% Mn, and the balance Mg was manufactured by a casting method and a magnesium based alloy powder (grain diameter: 0.5 to 1.5 mm) was obtained from the material. This Mg alloy powder was heated up to 150° C. and rolled to miniaturize the powder Mg crystal grain and miniaturize the compound dispersed in the matrix. The Mg alloy powder after such warm plastic forming process was solidified by molding and heated up and maintained at 420° C. for 5 minutes in an inert gas atmosphere and then immediately a warm extrusion process (extrusion ratio: 20) was performed for it.

Meanwhile, according to the comparative example, Mg alloy powder provided by a cutting process without the above rolling process was directly formed by molding and it is processed by heating and warm extrusion process in the same condition to be an extruded material. According to the inventive example, the tensile strength of the extruded material was 397 MPa and the breaking extension thereof was 11.4% at room temperature, while according to the comparative example, the tensile strength of the extruded material was 316 MPa and the breaking extension thereof was 6.5%.

Figure 6A:
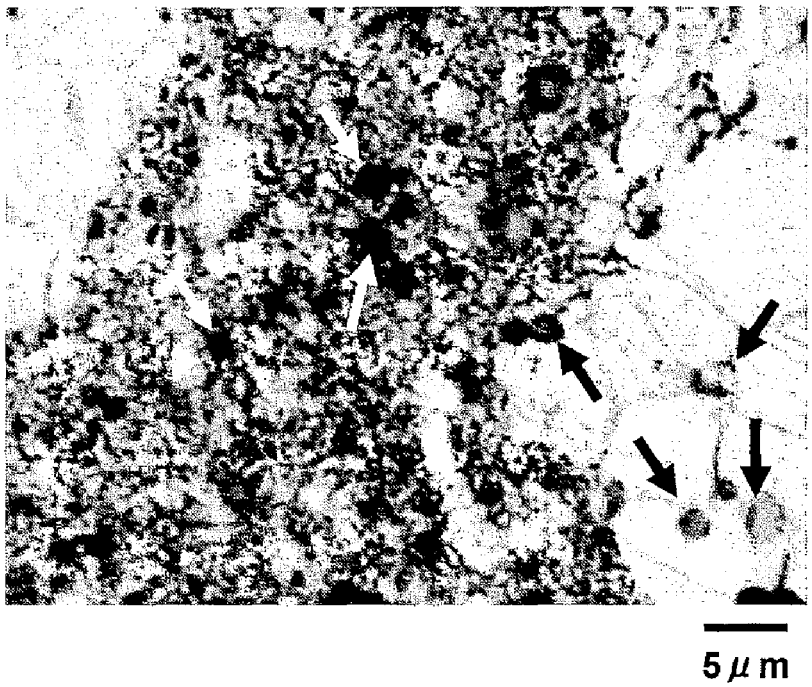
FIG. 6A shows a structure photograph of an extruded material (working example)
Figure 6B:
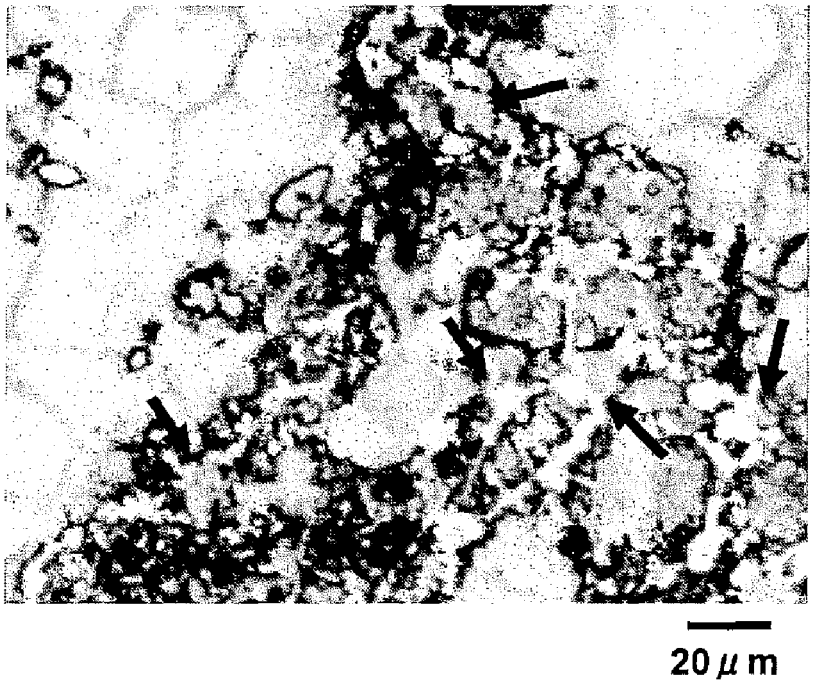
FIG. 6B shows a structure photograph of an extruded material (comparative example).

The structures of those extruded materials are shown in FIG. 6. According to the inventive example shown in FIG. 6(*a*), the compound (here, $Al_2Ca$ and $Mg_{17}Al_{12}$) dispersed in the matrix has a spherical shape or a shape close to it and uniformly dispersed in the grain boundary and the grain of the Mg crystal grain. As a result of image analysis, the ratio (D/d) of the maximum grain diameter "D" to the minimum grain diameter "d" of the compound is 1.2 to 2.4 and the maximum grain diameter is 3.8 μm.

Meanwhile, according to the comparative example shown in FIG. 6(*b*), a network-like compound ($Al_2Ca$ and $Mg_{17}Al_{12}$) connected along the Mg crystal grain boundary exists and as a result of the similar image analysis, it is found that the intermetallic compound is coarse and have a high D/d value exceeding 10 and its longest diameter is more than 30 μm.

Example 4

Magnesium based alloy powder (grain diameter: 0.5 to 2 mm) having the alloy composition of each of samples No. 1 to 4 and 8 shown in Table 2 was prepared and each powder was heated up to about 150° C. to be processed by shearing and compression processes so that the Mg crystal grain and the deposited and dispersed compound in the powder material were miniaturized. Then, a mold was filled with the powder and then a powder solidified body was manufactured by compression molding. This solidified body was maintained at 400° C. for 5 minutes in an inert gas atmosphere and then immediately a warm extrusion process was performed for it to provide an extruded material (diameter: 7.2 mm ϕ).

Magnesium based alloys of the samples 5 to 7 are ingot materials manufactured by the casting method.

The structure in the extruded direction of the above material was observed after polishing and chemical etching and the maximum crystal grain diameter of the Mg matrix and the maximum grain diameter of the Al—Mn group compound were measured by image analysis.

In addition, a round rod extensile test piece (diameter: 3 mm ϕ and parallel part: 15 mm) was obtained from the extruded material and tested at room temperature and 150° C. The tensile speed was kept constant at 0.3 mm/min.

Furthermore, in order to evaluate the corrosion resistance of each sample, a pillar sample having a diameter of 6.8 mm ϕ and a length of 80 mm was obtained from the extruded material and this was immersed in NaCl aqueous solution having a concentration of 5% and pH 10 (solution temperature; 35° C.) for 72 hours and its corrosion speed ($mg/cm^2$) was calculated from a reduced weight amount before and after the test. These characteristic evaluation results are shown in Table 2.

According to each of the inventive examples 1 to 4, the extruded material has the appropriate alloy composition and appropriate Mg maximum crystal grain diameter defined by the present invention, so that each has superior mechanical characteristics and corrosion resistance at room temperature. Especially, as the Mn content is increased within a range of 1.5% or more, the Fe content in the Mg alloy is decreased and as a result, the corrosion resistance is improved (corrosion speed is lowered). In addition, the tensile strength is increased as the Mn content is increased, which is because the dispersion of the Al—Mn group compound miniaturized to 10 μm or less is enhanced.

Meanwhile, according to the comparative examples 5 to 7, since the extruded material was manufactured by the casting method and does not have the Mg crystal grain diameter defined by the present invention, it does not have enough strength. At the same time, since the Al—Mn group compound becomes coarse such that its grain diameter is beyond 30 μm, which is one factor causing the strength and toughness of the Mg alloy to be lowered.

Meanwhile, according to the comparative example 8, although it has a Mg crystal grain diameter of 20 μm or less and have superior mechanical characteristics, since it does not contain Mn, a Fe content is increased to 135 ppm. As a result, the corrosion resistance of the Mg alloy is considerably lowered.

TABLE 2

| | | Chemical composition in weight | | | | | | | | | Maximum crystal grain diameter of | Grain diameter of Al—Mn | Tensile characteristics at room temperature | | | Corrosion |
|---|---|---|---|---|---|---|---|---|---|---|---|---|---|---|---|---|
| | No. | RE | Ca | Zn | Al | Mn | Fe (ppm) | Si | Ag | Mg | matrix (μm) | compound (μm) | UTS (MPa) | Extension (%) | σ × ε (MPa. %) | Speed (mg/cm2) |
| Inventive example | 1 | 3.0 | 1.5 | 0.5 | 7.0 | 1.6 | 10 | 0.0 | 0.0 | balance | 12.2 | 5.2 | 397 | 13.1 | 5201 | 11.3 |
| | 2 | 3.0 | 1.5 | 0.5 | 7.0 | 2.3 | 8 | 0.0 | 0.0 | balance | 13.4 | 8.2 | 402 | 11.2 | 4502 | 9.6 |
| | 3 | 3.0 | 1.5 | 0.5 | 7.0 | 2.9 | 6 | 0.0 | 0.0 | balance | 12.6 | 6.4 | 408 | 10.8 | 4406 | 7.2 |
| | 4 | 3.0 | 1.5 | 0.5 | 7.0 | 3.6 | 3 | 0.0 | 0.0 | balance | 11.5 | 7.5 | 418 | 9.9 | 4138 | 5.4 |

TABLE 2-continued

| | | Chemical composition in weight | | | | | | | | | Maximum crystal grain diameter of | Grain diameter of Al—Mn | Tensile characteristics at room temperature | | | Corrosion |
|---|---|---|---|---|---|---|---|---|---|---|---|---|---|---|---|---|
| | No. | RE | Ca | Zn | Al | Mn | Fe (ppm) | Si | Ag | Mg | matrix (μm) | compound (μm) | UTS (MPa) | Extension (%) | σ × ε (MPa. %) | Speed (mg/cm2) |
| Comparative example | 5 | 3.0 | 1.5 | 0.5 | 7.0 | 1.6 | 10 | 0.0 | 0.0 | balance | 112.5 | 36.8 | 182 | 4.6 | 837 | 12.2 |
| | 6 | 3.0 | 1.5 | 0.5 | 7.0 | 2.3 | 8 | 0.0 | 0.0 | balance | 126.6 | 45.8 | 412 | 3.4 | 1401 | 10.1 |
| | 7 | 3.0 | 1.5 | 0.5 | 7.0 | 2.9 | 6 | 0.0 | 0.0 | balance | 121.8 | 57.7 | 418 | 2.6 | 1087 | 7.9 |
| | 8 | 3.0 | 1.5 | 0.5 | 7.0 | 0.0 | 135 | 0.0 | 0.0 | balance | 12.4 | none | 365 | 13.8 | 5037 | 287.0 |

Although the embodiments of the present invention have been described with reference to the drawings in the above, the present invention is not limited to the above-illustrated embodiments. Various kinds of modifications and variations may be added to the illustrated embodiments within the same or equal scope of the present invention.

INDUSTRIAL APPLICABILITY

The present invention is applied to a magnesium based alloy having superior strength characteristics and superior toughness at room temperature and at a high temperature up to 200° C. Especially, since a high-strength and high-toughness magnesium based alloy according to the present invention comprises a magnesium matrix having a fine crystal grain diameter and has a structure in which a fine granular intermetallic compound is uniformly deposited and dispersed in its crystal grain, it can be advantageously applied to an engine or a driving part of a car or a two-wheeled motor vehicle.

The invention claimed is:

1. A manufacturing method of a high-strength and high-toughness magnesium based alloy material comprising the steps of:

manufacturing a magnesium alloy ingot by a casting method, the magnesium alloy ingot containing, by weight, 1 to 8% rare earth element and 1 to 6% calcium and dispersing an intermetallic compound containing at least one of the rare earth element and the calcium along a crystal grain boundary of a magnesium matrix;

obtaining magnesium alloy powder from the magnesium alloy ingot through a machining process;

performing a plastic forming process to the magnesium alloy powder for miniaturizing the magnesium crystal grain that constitutes the matrix and for grinding the intermetallic compound finely to disperse the intermetallic compound inside the magnesium crystal grain;

manufacturing a powder solidified body from said miniaturized magnesium based alloy powder by compression molding; and providing the magnesium based alloy material by heating said powder solidified body and performing a warm extrusion process to it.

2. The method according to claim 1, wherein said magnesium alloy ingot contains, by weight, 2 to 15% aluminum and disperses the intermetallic compound containing the aluminum along the crystal grain boundary of the magnesium matrix, and the intermetallic compound containing the aluminum is finely ground and dispersed inside the magnesium crystal grain by said plastic forming process to the magnesium alloy powder.

3. The method according to claim 1, wherein the maximum crystal grain diameter of the magnesium matrix of the magnesium based alloy material is not more than 30 um and the maximum grain diameter of the intermetallic compound is not more than 20 um.

4. The method according to claim 1, wherein a relation between the maximum grain diameter of the intermetallic compound "D" and the minimum grain diameter thereof "d" in the magnesium based alloy material satisfies $D/d \leqq 5$.

5. The method according to claim 1, wherein the powder solidified body before the warm extrusion process is heated up to 300 to 520° C. and maintained for 30 seconds.

* * * * *